United States Patent [19]

Inouchi

[11] Patent Number: 4,951,649

[45] Date of Patent: Aug. 28, 1990

[54] METHOD AND APPARATUS FOR HEATING AND GENERATING INFRARED RAYS

[76] Inventor: Katsuyoshi Inouchi, 1-2-601, Namiki 2-chome, Kanazawa-ku, Yokohama-shi, Kanagawa-ken, Japan

[21] Appl. No.: 152,035

[22] Filed: Feb. 3, 1988

[30] Foreign Application Priority Data

Feb. 6, 1987 [JP] Japan ..... 62-024645

[51] Int. Cl.[5] ..... F24C 3/00

[52] U.S. Cl. ..... 126/91 A; 126/92 C; 126/293; 432/222

[58] Field of Search ..... 126/91 A, 293, 91 R, 126/92 R, 92 AC, 92 C, 285 R; 431/170, 181, 328, 284, 329; 432/222; 237/50–55

[56] References Cited

U.S. PATENT DOCUMENTS

| | | | |
|---|---|---|---|
| 2,064,095 | 12/1936 | Wilson | 126/91 A |
| 3,260,460 | 7/1966 | Marland | 126/92 B |
| 3,469,929 | 9/1969 | Haag | 431/1 |
| 3,796,212 | 3/1974 | Heuckroth | 126/92 B |
| 4,314,542 | 2/1982 | Bratko | 431/328 |

FOREIGN PATENT DOCUMENTS

| | | | |
|---|---|---|---|
| 989241 | 5/1976 | Canada | 34/86 |
| 58-18111 | 4/1983 | Japan . | |
| 57130653 | 2/1984 | Japan . | |
| 57130656 | 2/1984 | Japan . | |

*Primary Examiner*—James C. Yeung
*Attorney, Agent, or Firm*—William D. Hall

[57] ABSTRACT

The apparatus for heating and generating infrared rays has a heating apparatus for indirectly heating a heat medium such as air and water, by a combustion heat and a radiator, wherein a branch combustion gas passage is provided for a combustion gas passage through which the combustion gas in said heating apparatus flows at temperatures of 400° C. or more and 800° C. or less, and said branch combustion gas passage and said radiator are connected.

20 Claims, 2 Drawing Sheets

.FIG. 4

METHOD AND APPARATUS FOR HEATING AND GENERATING INFRARED RAYS

BACKGROUND OF THE INVENTION

The present invention relates to method and apparatus for converting a combustion heat of a fuel to infrared rays and for heating a human body or various kinds of objects.

In this specification, it is assumed that the infrared rays include far infrared rays whose wavelengths are 0.1 mm or less and, preferably 1 to 30 micron.

In recent years, it has been known that the light in the region called far infrared rays of long wavelengths in the infrared rays is the light which can be easily absorbed into the water, organic substance, human body, or the like.

The present invention intends to obtain method and apparatus in which a combustion heat of a fuel is converted to far infrared rays with a high heat efficiency and at the same time hot water, hot air, or the like are generated, and thereby efficiently heating a human body or objects.

As a conventional far infrared rays radiating apparatus using a combustion heat as a heat source, there has been widely known an apparatus in which a fuel is combusted in a tubular combustion chamber, the combustion gas in the downstream of the tubular combustion chamber is led into the radiating pipe and allowed to flow therethrough, and the far infrared rays are radiated from the outer surface of the tubular combustion chamber and the outer surface of the radiating pipe.

The apparatus of this system has the following problems. In the ordinary combusting method, a temperature of combustion flame reaches a high temperature of 1500° to 2000° C. or more. Therefore in particular, if the water cooling or forced air cooling is not performed, the surface temperature of the combustion pipe rises too high to about 800° to 1500° C., so that it is heated in red and burned out. Even if it is burned out, since the temperature is too high, the near infrared rays of short wavelength are mainly irradiated. Thus, such an apparatus is improper as a far infrared rays radiating apparatus.

SUMMARY OF THE INVENTION

As a method of solving this problem, there has been used recently a method whereby ceramics are closely adhered onto the outer surface of the combustion pipe, the temperature of the outer surface of the ceramics is reduced by the adiabatic effect of the ceramics, thereby radiating the far infrared rays from the outer surface of the ceramics. However, this method is not so widely used since it has drawbacks such that the ceramics are easily broken and are easily peeled off due to the difference of thermal expansion coefficient with iron, and further iron in the inside being burned out.

As another method of reducing the outer surface temperature of the combustion pipe, there is a method whereby an inner cylinder is further provided in the inside of the combustion pipe, the inside of the inner cylinder is used as a combustion chamber, the air for cooling is allowed to forcedly flow between the inner and outer cylinders to thereby cool the outer surface of the inner cylinder and the inner surface of the outer cylinder, and at the outlet of the inner cylinder having a length of at least a distance or longer at which the combustion is completely finished, the combustion gas is mixed to the combustion gas at a high temperature which flows out of the inside of the inner cylinder, thereby reducing the temperature of the combustion gas and setting the combustion outer cylinder to a proper lower temperature. This system has already been known by an apparatus disclosed in Japanese Utility Model Examined Publication No. 18111/83 or the like.

However, the above method whereby the temperature of the surface of the combustion pipe nozzle is reduced by use of the cooling air in addition to the combustion air has drawbacks such that the heat loss of the exhaust air increases and the heating efficiency deteriorates since the cooling air is heated to a high temperature and exhausted.

On the other hand, as a fuel which is used in the apparatus to convert the combustion heat to the far infrared rays, a gaseous fuel such as town gas and LPG, or a liquid fuel such as kerosine is used. However, the oil burner which is on/off controlled can be hardly operated at a combustion load of 15,000 kcal/h or less (lower calorific value reference; all of the calorific values will be disclosed as lower calorific values hereinafter). The burner which is high/low controlled, in which a combustion amount is automatically increased or decreased, can be hardly operated at a combustion load of 30,000 kcal/h or less. Therefore all of small-sized far infrared rays radiating apparatuses having combustion loads lower than those values use a gaseous fuel as a heat source. In such apparatuses, an apparatus using a liquid fuel such as kerosine is not yet put into practical use.

The reasons are as follows. The lower limit value of the combustion amount of the pressure spray type oil burner as a combustion apparatus of a liquid fuel which is presently most widely utilized and has the highest reliability in Japan is about the foregoing values. In the case of a burner of a combustion amount lower than that value, a hole diameter of nozzle to blow out the fuel oil is too small and it is difficult to work the hole of a high accuracy. Even if such a nozzle can be manufactured, the hole diameter is too small, so that the nozzle cannot be used because the nozzle will be choked in a short time and the nozzle hole will be deformed.

At present, as such a burner to combust a small amount of kerosine, a vaporizing type burner is widely used as a petroleum hot air type heater. However, the vaporizing type burner has a drawback such that when it is used for a long time, the carburetor section is choked by carbon or the like and cannot be used.

The heating apparatus for use at home is used only in the winter season for only about 5 to 8 hours per day as an average. However, if the foregoing vaporizing type burner is attached to the far infrared rays radiating apparatus and this radiating apparatus is used in the industrial or technological field or the like such as a sauna which is operated for 24 hours per day and for 350 days or more per year, there is a large possibility such that it cannot be used for about half or one year. Therefore the above vaporizing type burner is also improper as a combustion apparatus for use in a small-sized far infrared rays radiating apparatus which burns a kerosine.

The present invention is made to solve various kinds of problems as mentioned above and it is an object of the invention to improve the drawback such that the heating efficiency is low in the conventional apparatus in which the low temperature air is led and mixed to thereby reduce the surface temperature of the combustion pipe. Another object of the invention is to provide method and apparatus for radiating far infrared rays in which even in the small-sized far infrared rays radiating apparatus of 15,000 kcal/h or less, a liquid fuel such as kerosine other than a gas can be used as a fuel necessary.

Namely, as the result of the various examinations and devices, the present invention solves the conventional problem such that the nozzle of a small hole diameter must be used. The invention has developed techniques such that by enabling the pressure spray type oil burner having the highest reliability for use, even in the small-sized apparatus, the liquid fuel such as kerosine can also be used as a necessary fuel and at the same time, even if the cooling air as in the conventional far infrared rays radiating apparatus of the cooling air mixing type is not used, the surface temperature of the combustion pipe can be reduced by only the necessary amount. On the basis of these techniques, the invention intends to develop and provide method and apparatus for radiating far infrared rays having both advantages such that the exhaust air amount is smaller and the heating efficiency is higher as compared with those in the conventional apparatus.

The above objects are accomplished by a method whereby the fuel is combusted in the combustion chamber which is cooled by the heat medium, a temperature of combustion gas is reduced to a value of 800° or less and 400° C. or more and thereafter, the combustion gas is led to the radiator, thereby radiating the infrared rays, and at the same time the heat absorbed by the heat medium is effectively used.

Water or air can be preferably used as a heat medium.

One of the apparatuses for heating and generating infrared rays to embody the foregoing method is characterized in that a heating apparatus for indirectly heating a heat medium such as air and water by the combustion heat and a radiator are provided, a branch combustion gas passage is provided for a combustion gas passage through which the combustion gas in the heating apparatus flows at temperatures of 400° or more and 800° C. or less, and the branch combustion gas passage and the radiator are connected.

On the other hand, another apparatus for heating and generating infrared rays to embody the foregoing method is characterized in that an outer cylinder is provided in the outside of a (3) cylindrical combustion chamber, the air is allowed to forcedly flow in the space between the outer cylinder and the cylindrical combustion chamber to thereby form an air heating apparatus, a tubular radiator is disposed in a downstream pipe of the cylindrical combustion chamber, and a hot air blow-out port is formed in the air heating apparatus.

According to the method and apparatus of the invention constituted as mentioned above, it is possible to obtain a far infrared rays radiating apparatus in which the fuel is perfectly combusted by the combustion air amount near the theoretical air amount of the best heating efficiency, the combustion heat is absorbed by only the necessary amount into the water, air, or other heat medium, a temperature of combustion gas is reduced to the temperature suitable for radiating the far infrared rays, the combustion gas at a proper temperature is allowed to flow through the inside of a far infrared rays radiating body like a tube and plate, to thereby generate far infrared rays, the heat of the heat medium heated by this apparatus is effectively used, thereby obtaining a synthetically higher heating efficiency than that of the conventional far infrared rays radiating apparatus by the combustion heat.

In other words, although the air ratio is low, the temperature of the exhaust gas is high. Therefore, by manufacturing a boiler or hot air blower of a low heating efficiency and by using the high temperature exhaust gas as a heat source of the far infrared rays radiating apparatus, the temperature of the radiating body can be set to a proper temperature. By effectively using the heat which is lost by the cooling of the exhaust gas, the heating efficiency can be synthetically improved.

In this manner, the far infrared rays radiating apparatus by the combustion heat of a good heating efficiency can be provided. The apparatus according to the invention has effects serving triple purposes. Namely, in the conventional apparatus using the pressure spray type oil burner, the lower limit value of the combustion amount is about 15,000 kcal/h by on/off control and is about 30,000 kcal/h by high/low control. However, according to the apparatus of the invention, the pressure spray type oil burner by high/low control of 30,000 kcal/h is used, 20,000 kcal/h in the generated heat is used for the boiler or hot air blower, and the remaining heat is used for the far infrared rays radiating apparatus. Thus, the oil burning far infrared rays radiating apparatus by high/low control of the combustion amount of 10,000 kcal/h is obtained.

Further, by using various devices, as shown in the second embodiment of the invention, which will be explained hereinafter, it is also possible to manufacture the oil burning far infrared rays radiating apparatus by high/low control of the combustion amount corresponding to about 5,000 kcal/h or the small-sized apparatus of the combustion amount of 2,000 to 3,000 kcal/h lower than that value. It is possible to provide a small-sized oil burning far infrared rays radiating apparatus of a heat load of 1/10 or less of the conventional one.

Further, by organically combining the hot water, steam, high temperature heat medium, hot air, and the like which are secondarily produced with the far infrared rays, the more excellent heating apparatus, drying apparatus, sauna equipment, or the like is derived.

BRIEF DESCRIPTION OF THE DRAWINGS

The details of method and apparatus for heating and for generating infrared rays according to the present invention will be described hereinbelow with reference to the drawings.

FIG. 4 is a front view with a part cut away showing the third embodiment of an apparatus to embody the method of heating and generating infrared rays according to the invention. In the diagrams, the composing elements having the same or similar functions are designated by the same reference numerals.

DETAILED DESCRIPTION OF THE PREFERRED EXEMPLARY EMBODIMENTS

Figure 1:
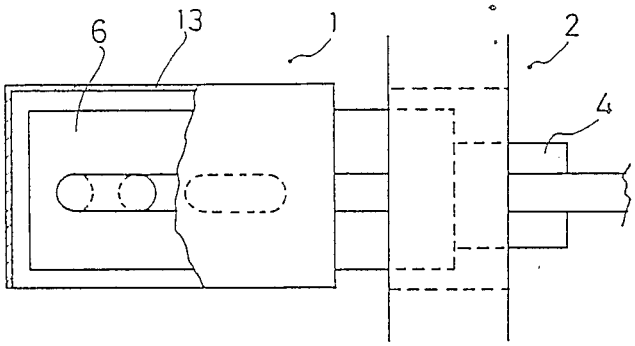
FIG. 1 is a plan view with a part cut away showing the first embodiment of an apparatus to embody the method of heating and generating infrared rays according to the invention.
Figure 2:
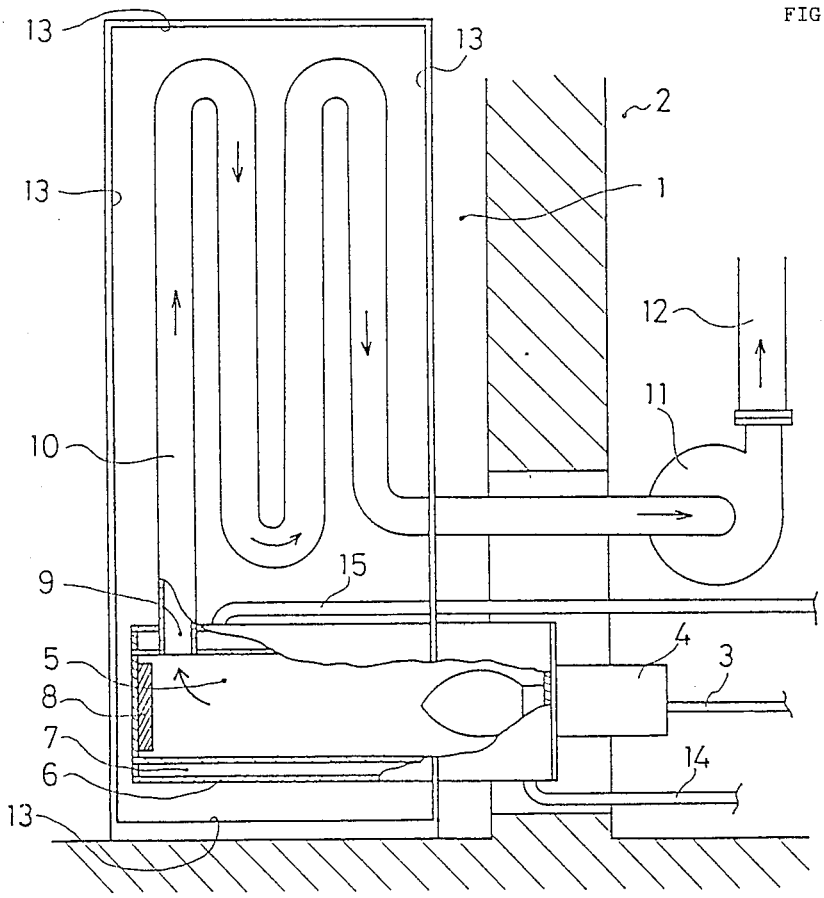
FIG. 2 is a front view with a part cut away of the first embodiment shown in FIG. 1.

The first embodiment shown in FIGS. 1 and 2 will be first described. In these diagrams, reference numeral 1 denotes a heating room; 2 a machine room; 3 an oil feed pipe; 4 a pressure spray type oil burner; 5 a combustion chamber; 6 an outer cylinder; 7 a water chamber; 8 a downstream side wall of the combustion chamber 5; 9 a combustion gas outlet; 10 a radiator consisting of a far infrared rays radiating pipe; 11 a blower; 12 a chimney; 13 reflecting plates; 14 a water feed pipe; and 15 a hot water feed pipe.

The machine room 2 is provided adjacent to the heating room 1 such as sauna room, drying room, for heating by radiating far infrared rays. A kerosine is fed from the machine room 2 to the pressure spray type oil burner 4 through the oil feed pipe 3. The combustion is started in the combustion chamber 5 projected in the heating room 1.

The outer cylinder 6 is attached to the outer periphery of the cylindrical combustion chamber 5. A water is filled in the space between the outer wall of the combustion chamber 5 and the inner wall of the outer cylinder 6 to thereby form the water chamber 7. In this manner, a hot water boiler is formed.

The high temperature combustion gas flows into the tubular far infrared rays radiating pipe 10 from the combustion gas outlet 9 near the downstream side wall 8 of the heat insulated combustion chamber 5, while reducing the temperature by giving the heat to the water chamber 7 surrounding the combustion chamber 5.

A combustion amount, a heat transfer area of the combustion chamber, a flow rate of heat medium, and the like are determined so that a temperature of combustion gas at this time is set to a value of about 800° or less and about 400° C.

The reason why the upper limit temperature is set to 800° C. is that if the temperature of the combustion gas is set to about this value, when it is assumed that the temperature of the heating room 1 is 100° C., the highest temperature of the radiating pipe 10 becomes a temperature slightly higher than (800°+100° C.)/2=450° C., namely about 500° C. or less.

In the case of the temperature of about 500° C., the steel sheet is not heated in red and the wavelengths of infrared rays which are most strongly radiated from the radiating pipe 10 are about 3.7 micron and near the wavelength in the range of the far infrared rays (in general, the infrared rays of long wavelengths of 4 micron or more are referred to as far infrared rays) and at the same time, the radiating pipe 10 radiates the heat. Therefore the temperature on the downstream side decreases and, as a whole the light in the range of the far infrared rays is mainly irradiated.

The reason why the lower limit temperature is set to 400° C. or more is that the final temperature of the exhaust gas must be set to at least about 200° C. and if it is too low, an amount of far infrared rays generated decreases.

The combustion gas which entered the radiating pipe 10 irradiates the light mainly consisting of the far infrared rays from the surface of the radiating pipe 10, while vertically flowing in the radiating pipe as indicated by arrows and gradually reducing the temperature. Then, the light is led from the side of the heating room 1 to the side of the machine room 2 and is attracted by the blower 11 and exhausted from the chimney 12.

The light irradiated from the radiating pipe 10 collides with the reflecting plates 13 and is reflected and progresses toward the inside of the heating room. Then the light collides with an object to be heated and is converted into the heat, thereby heating the object to be heated.

The water is supplied from the water feed pipe 14 to the water chamber 7. The heated hot water is sent from the hot water feed pipe 15 to the outside and consumed as the hot water or used as a heat source of the hot water heating or the like.

When the temperature of the heating room 1 becomes slightly higher than a set temperature, the combustion amount of the pressure spray type oil burner 4 is reduced to about ½.

To reduce the fuel amount, there are following methods: the method whereby the oil pressure on the upstream side of the oil spray nozzle is reduced to decrease the blowout amount of the oil; and the method whereby two oil spray nozzles are provided, in the case of the low combustion, a passage to supply the oil to one of the oil spray nozzles is closed by use of a solenoid valve or the like, in the case of the high combustion, the oil is blown out of the two oil spray nozzles, and in the case of the low combustion, the combustion is performed by only one oil spray nozzle, thereby reducing the fuel amount.

The method whereby the combustion amount is increased or decreased by adding or dropping the oil pressure is suitable for a proportional control. In the case of high/low control, the method using plural oil spray nozzles is more convenient and the manufacturing cost is cheap.

In the case of the smallest apparatus in the first embodiment of the invention in which high/low control is executed by providing two oil spray nozzles, the combustion amount of the oil spray nozzle of which the oil spray amount is the smallest is about 15,000 kcal/h (lower calorific value reference; the oil pressure at this time is about 7 kg/cm$^2$) as mentioned above. Therefore two minimum oil spray nozzles are used. The combustion amount is set to 30,000 kcal/h in the case of the high combustion and is set to 15,000 kcal/h in the case of the low combustion.

According to the smallest apparatus in the first embodiment of the invention, in order to set the temperature of the combustion gas in the portion of the combustion gas outlet 9 to about 800° C., when the air ratio is 1.2 (excess air ratio is 20%), it is sufficient to transfer about 60% of the combustion amount to the water. When the air ratio is 1.6, it is enough to transfer the heat of about 50% to the water.

Namely, in the case of the air ratio 1.2, the apparatus is commonly used as the hot water boiler of the heat output of 18,000 kcal/h (30,000×0.6) for the high combustion and as the far infrared rays radiating apparatus of the heat input of 12,000 kcal/h. In the case of the low combustion, the heat amounts are reduced to about ½of those values, respectively.

To set the temperature of the combustion gas outlet 9 to about 400° C., it is sufficient to transfer the heat of about 80% to the water at the air ratio of 1.2 and the heat of about 75% to the water at the air ratio of 1.6.

The heat input of the far infrared rays radiating apparatus in this case is about 6,000 kcal/h (air ratio of 1.2) or about 7,500 kcal/h (air ratio of 1.6) in the case of the high combustion.

Therefore it is possible to manufacture a small-sized oil burning far infrared rays radiating apparatus corresponding to the combustion amount of about 1/5 of that in the conventional far infrared rays radiating apparatus having the pressure spray type oil burner for performing high/low control.

The above-described first embodiment is an embodiment of the apparatus to exemplify the method disclosed in claim 1.

Figure 3:
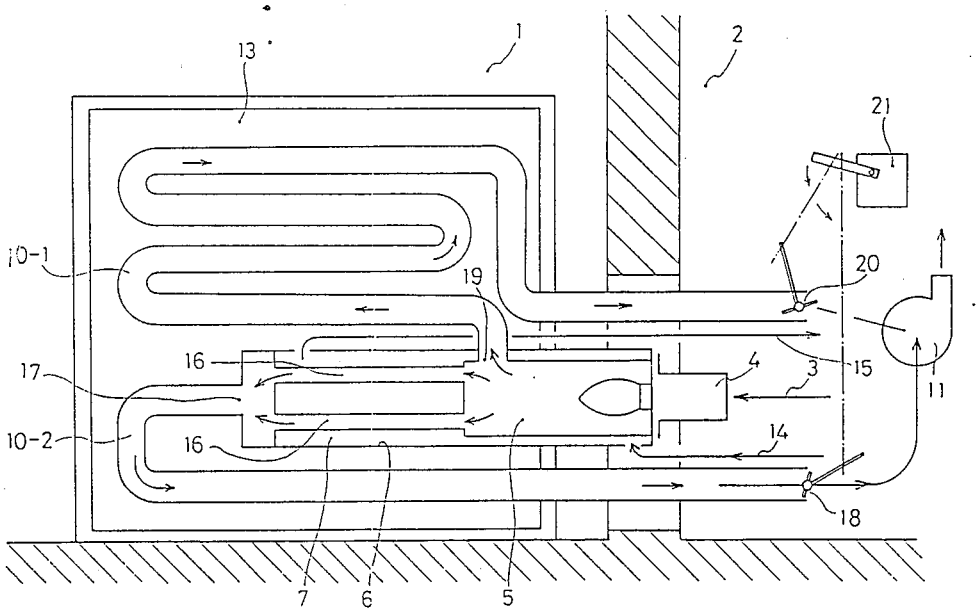
FIG. 3 is a front view with a part cut away showing the second embodiment of an apparatus to embody the method of heating and generating infrared rays according to the invention.
Figure 3:
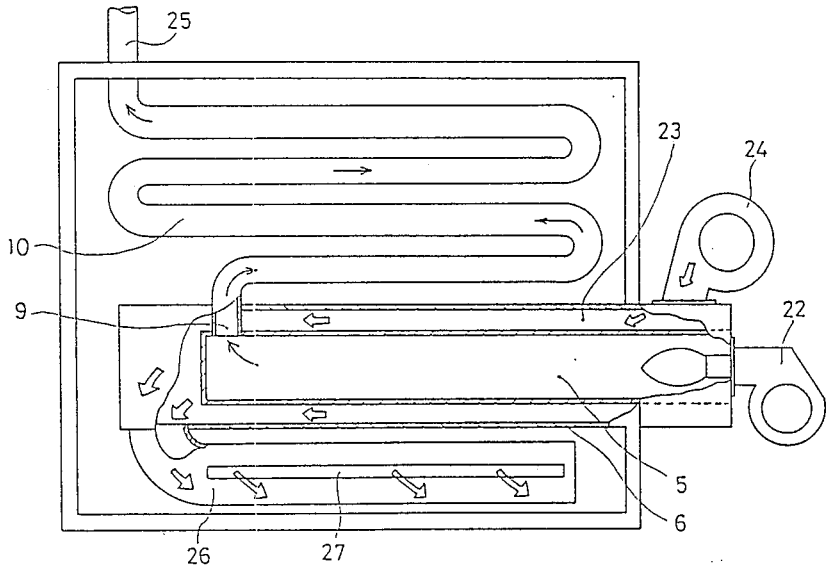

Next, FIG. 3 is a front view with a part cut away of another embodiment of an apparatus to exemplify the method disclosed in claim 1 according to the second embodiment of the invention.

In this embodiment, the fuel oil is also fed from the oil feed pipe 3 of the machine room 2 to the pressure spray type oil burner 4 and the combustion is started in the combustion chamber 5.

The outer cylinder 6 is provided for the outer periphery of the combustion chamber 5. The intermediate portion between them serves as the water chamber 7. Plural smoke pipes 16 are provided in the water chamber 7 in the downstream of the combustion chamber 5. The combustion gas of which the temperature was reduced by transferring the heat to the water in the combustion chamber 5 passes through the inside of the smoke pipes 16 as indicated by arrows. Further, the combustion gas transfers the heat to the water chamber 7 and reduces the temperature. The combustion gas is led from an exhaust port 17 to the side of the machine room 2 through a far infrared rays radiating pipe 10-2 using the exhaust gas and passes through a boiler damper 18. Then the gas is attracted by the blower 11 and is exhausted to the outdoor.

The water is supplied from the water feed pipe 14 to the water chamber 7. The hot water heated in the water chamber 7 is fed from the hot water feed pipe 15 to the necessary portions in the outside.

If the temperature of the far infrared rays radiating pipe 10-2 using the exhaust gas in the apparatus with the foregoing structure is held and this pipe is used as a smoke path for the exhaust gas, an ordinarily well-known smoke pipe type hot water boiler of the lateral type is obtained.

A branch combustion gas passage 19 is provided in the downstream portion of the combustion chamber 5 of the smoke pipe type hot water boiler-like apparatus. The branch combustion gas passage 19 is connected with radiating pipes 10–1. Four radiating pipes 10-1 are provided in zigzags in the horizontal direction. After that, the pipe is led to the outside of the heating room 1 and enters the machine room 2 and is coupled with the attraction side of the blower 11 through a far infrared rays radiating damper 20.

Both of the dampers are automatically opened or closed by a control motor 21. However, a state of FIG. 3, namely the boiler damper 18 is slightly closed (in a slightly open state) and the far infrared rays radiating damper 20 almost fully open is obtained in the case where the temperature of the heating room 1 is low. In this state, therefore a larger quantity of far infrared rays must be irradiated.

In the second embodiment, the pressure spray type oil burner 4 does not increase or decrease the combustion amount by on/off control.

Most of the combustion gas whose temperature was reduced to about 400° to 800° C. by transferring the heat to the water chamber 7 in the combustion chamber 5 flows as indicated by arrows in the direction of the far infrared rays radiating damper 20 having a large opening degree of the damper through the branch combustion gas passage 19 and radiating pipes 10-1 as shown in FIG. 3.

The remaining small amount of combustion gas passes through the smoke pipes 16 and further reduces the temperature and flows out from the exhaust port 17 to the far infrared rays radiating pipe 10-2 using the exhaust gas (it is desirable that the temperature of the combustion gas in the exhaust port 17 is 250° to 350 ° C.). The far infrared rays are irradiated into the heating room 1 and the temperature is further reduced by this gas. Then the gas passes through the boiler damper 18 and is exhausted to the outdoor by the blower 11 as shown by arrows.

When the temperature of the heating room 1 rises to a value of a proper temperature or more, the control motor 21 rotates and operates in the direction indicated by an arrow in response to a command of a temperature adjusting instrument or the like to detect the temperature in the heating room 1. Contrary to FIG. 3, the boiler damper 18 is largely opened and the far infrared rays radiating damper 20 is slightly opened.

Therefore the amount of combustion gas flowing into the branch combustion gas passage 19 decreases remarkably. The amount of far infrared rays which are radiated from the radiating pipes 10-1 decreases. The amount of combustion gas flowing increases. Thus the amount of rays which are radiated from the far infrared rays radiating pipe 10-2 using the exhaust gas also increases. However, the synthetic radiation amount of the far infrared rays decreases, thereby preventing the increase in temperature in the heating room 1.

The quantity of heat which is transferred to the water increases by the amount corresponding to the heat amount of the reduction in the radiation amount of the far infrared rays. The temperature of the hot water supplied from the hot water feed pipe 15 rises.

To make it easily understood, an explanation will be made by assuming practical numerals.

The combustion amount is set to 15,000 kcal/h (the lowest combustion amount of the pressure spray type oil burner). The air ratio is set to 1.2. The temperature of the downstream portion (near the inlet of the smoke pipes 16) in the combustion chamber 5 is set to 800° C. When the temperature of the heating room 1 is low (in the case of the higher far infrared rays radiating amount), the heat of 60%, i.e., about 9,000 kcal/h of the combustion amount is given to the water in the combustion chamber 5 as explained in the first embodiment. The heat of 80% of the remaining heat, namely, about 4,800 kcal/h is transferred from the branch combustion gas passage 19 to the radiating pipes 10-1. On this assumption, the radiating effect of about 100 kcal/h can be expected from the far infrared rays radiating pipe 10-2 using the exhaust gas. Therefore, as a far infrared rays radiating apparatus, the heat input is about 4,900 kcal/h. As a hot water boiler, the heat output is about 9,200 kcal/h.

When the temperature of the heating room 1 rises and the control motor 21 operates (in the case of the lower far infrared rays radiating amount), the boiler damper 18 is opened and the far infrared rays radiating damper 20 is closed (although it is slightly open).

At this time, since the combustion amount does not change in the downstream portion of the combustion chamber 5, the heat of 60% of the combustion amount, i.e., 9,000 kcal/h is absorbed. The heat of 30%, i.e., 1,800 kcal/h of the combustion gas at the temperature of 800° C. having the heat amount of 6,000 kcal/h is led from the branch combustion gas passage 19 to the radiating pipes 10-1. The heat of the remining 4,200 kcal/h passes through the inside of the smoke pipes 16. The heat of about 2,600 kcal/h is further given to the water chamber 7. The combustion gas at a temperature of about 330° C. having the heat amount of 1,600 kcal/h flows into the far infrared rays radiating pipe 10-2 using the exhaust gas. The far infrared rays are irradiated to the heating room 1 and the temperature is further reduced. When the combustion gas passes through the open boiler damper 18, the temperature of the combustion gas is reduced to about 200° C. and the heat amount decreases to about 1,000 kcal/h. This gas is attracted by the blower and exhausted to the outdoor.

On the other hand, the combustion gas which flowed into the radiating pipes 10-1 radiates the far infrared rays to the heating room 1 and reduces the temperature. This gas passes through the far infrared rays radiating damper 20 and blower and is similarly exhausted to the outdoor.

According to the apparatus in the second embodiment of the invention in the case of the lower far infrared rays radiating amount (when the temperature of the heating room 1 is higher than a set value) mentioned above, the heat output is 9,000+2,600=11,600 kcal/h as a hot water boiler. As a far infrared rays radiating apparatus, 1,800 kcal/h is obtained in the case of the far infrared rays radiating pipes 10-1. About 700 kcal/h is obtained in the case of the far infrared rays radiating pipe 10-2 using the exhaust gas. Thus the total heat input is equal to 2,500 kcal/h (51% of that in the case of the higher far infrared rays radiating amount).

Assuming that the temperature of the combustion gas which is exhausted from the far infrared rays radiating tubes 10-1 at this time was 200° C. in a manner similar to that of the far infrared rays radiating pipe 10-2 using the exhaust gas, the total loss of exhaust gas heat is equal to 1,400 kcal/h. The synthetic heating efficiency is (15,000−1,400)/15,000=90.7% (because the radiation heat loss hardly occurs).

In the second embodiment of the invention which has been described in detail above, the branch combustion gas passage has been provided in the hot water boiler. However, if a steam boiler is used in place of the hot water boiler, a heating and infrared rays generating apparatus according to the invention to generate the steam and far infrared rays is realized. In a manner similar to the above, if a boiler to heat a heat medium oil is used, there is obtained a heating and infrared rays generating apparatus for generating the high temperature heat medium oil and far infrared rays. If a hot air blower to indirectly heat the air is used in place of the hot water boiler, a heating and infrared rays generating apparatus for generating the hot wind and far infrared rays is derived.

FIG. 4 shows the third embodiment of the invention. The third embodiment shows a front view with a part cut away of a further different embodiment.

A pressure spray type oil burner (generally referred to as a gun type oil burner) having a positive blower 22 is attached to the upstream edge of the combustion chamber 5. The combustion is performed in the combustion chamber 5.

The outer cylinder 6 is provided in the outside of the combustion chamber 5. The air is forcedly sent by a hot air blower 24 into an air heating chamber 23 between the outer cylinder 6 and the combustion chamber 5. This air is heated while cooling the combustion chamber 5.

The combustion gas gradually reduces the temperature while transferring the heat to the air heating chamber 23. This gas flows from the combustion gas outlet 9 of the downstream portion of the combustion chamber into the far infrared rays radiating pipe 10 and passes in zigzags through the inside of the far infrared rays radiating pipe 10 as indicated by solid arrows while irradiating the far infrared rays from the far infrared rays radiating pipe 10. Thereafter the combustion gas is exhausted from a chimney 25 to the outdoor.

On the other hand, the air which was forcedly sent from the hot air blower 24 to the air heating chamber 23 is gradually heated and becomes the hot air. The hot air flows into a hot air blowout pipe 26 and is blown out from a slit-like hot air blowout port 27 toward the space near the floor in the room as shown by blank arrows.

An explanation will now be made by assuming practical numerals for easy understanding.

The combustion amount is set to 30,000 kcal/h in the case of the higher combustion and to 15,000 kcal/h (the lowest combustion amount of the pressure spray type oil burner for performing high/low control) in the case of the lower combustion. The air ratio is set to 1.2. The temperature of combustion gas in the downstream portion of the combustion chamber 5 is set to 800° C. in the case of the higher combustion. In the case of the higher combustion, as described in the first embodiment, the heat of 18,000 kcal/h corresponding to 60% of the combustion amount is given to the air in the air heating chamber 23 and the remaining 40%, i.e., the heat amount of 12,000 kcal/h flows into the radiating pipe 10 from the combustion gas outlet 9 and irradiates the far infrared rays. Then the combustion gas is exhausted from the chimney 25 to the outdoor.

Assuming that the blowout temperature of the hot air is 150° C., in the case of the hot air blower (of the indirect heating type ) of the heat output of 18,000 kcal/h, the amount of air which is sent from the hot air blower 24 is about 7 $m^3$/min.

Assuming that the apparatus of the third embodiment was used as a heating apparatus, the hot air of 150° C. and 7 $m^3$/min is sent from the position close to the feet of a human body standing toward the far infrared rays radiating direction. The far infrared rays of the heat input of 12,000 kcal/h (the heat output is about 9,000 kcal/h) are irradiated to the upper portion of the human body. A comfortable ideal heating apparatus is realized.

If the lower combustion such as to reduce the combustion amount to 15,000 kcal/h is set as necessary, the temperature of hot air is also reduced to about 80° C. and the irradiating amount of the far infrared rays also decreases to ½.

The effects of the present invention are mainly summarized to the following three points.

(1) There is no need to feed an extra air into the combustion chamber to reduce the surface temperature of the combustion pipe as in the conventional far infrared rays radiating apparatus by the combustion heat. Therefore the quantity of exhaust gas remarkably decreases and the heating efficiency fairly rises, so that the energy can be saved.

(2) In the far infrared rays radiating apparatus using a conventional oil burning pressure spray type oil burner, it is difficult to manufacture the far infrared rays radiating apparatus whose combustion amount is lower than the heat input of 15,000 kcal/h in the case of performing on/off control and is lower than 30,000 kcal/h in the case of high/low control. Such an apparatus is not manufactured. However, according to the invention, in the second embodiment, an oil burning far infrared rays radiating apparatus for performing the high/low control at the heat input of 4,800 kcal/h is obtained. A small-sized apparatus can also be manufactured as necessary as will be explained hereinafter. The small-sized far infrared rays radiating apparatus which had to use the gaseous fuel or electric power as a heat source can be also operated by a liquid fuel such as kerosine. In addition to the energy saving, various kinds of advantages are derived.

(3) Multieffects can be expected by efficiency combining the far infrared rays which are generated by the apparatus of the invention and the hot water and hot air which are secondarily generated, or a heat medium or the like of a higher temperature.

These effects will be described in detail hereinbelow.

The increase in heating efficiency disclosed in the item (1) will be first explained.

Some of the conventional far infrared rays radiating apparatuses by the combustion heat are constituted in a manner such that ceramics or the like are closely adhered to the outer surface of a steel pipe in a part of the apparatus, a fuel is combusted in the steel pipe, the temperature of the outer surface of the ceramics is reduced by use of the heat insulating effect of the ceramics, and the far infrared rays are irradiated from the outer surface of the ceramics of the lower temperature. However, like the apparatus disclosed in the Official Gazette of Japanese Utility Model Examined Publication No. 18111/83, most of those apparatuses are of the type in which an inner cylinder is provided in the combustion pipe, an air for cooling flows through the space between the inner cylinder and the outside combustion pipe, and after completion of the combustion, the cooling air and the combustion gas are mixed and further, the mixed gas flows in the radiating pipe, the far infrared rays are irradiated from the outer surface of the radiating pipe, and the combustion gas is exhausted to the outside.

All of the far infrared rays radiating apparatuses for heating or such apparatuses for use in sauna which are known in Japanese Patent Application Nos. 130653/82 130656/82 and the like have the foregoing type. In the case of the apparatuses which have already been put into practical use, the total quantity of the air for combustion and the air for cooling is set to about three or four times of the theoretical combustion air amount and the surface temperature of the combustion pipe is set to at most 500° C. or less.

If such a cooling air is used, the temperature of the combustion gas does not increase to at most 800° C. or more, so that the surface temperature of the combustion pipe does not increase too high.

When the air ratio is 3.5 and the exhaust gas temperature is 200° C., the exhaust gas heat loss is about 2,500 kcal/h per combustion amount of 10,000 kcal/h (lower calorific value). However, in the case of the apparatus of the invention, when the air ratio is about 1.2, the combustion can be completely performed. The surface temperature of the radiating pipe can be also easily reduced to 500° C. or less as mentioned in each embodiment.

In the recent oil burning hot water boiler and the like in general, the combustion is performed at the air ratio of about 1.2 or less. Therefore, in the apparatus of the invention, the combustion can be also easily executed at the air ratio of about 1.2.

The exhaust gas heat loss, when the air ratio is 1.2 and the exhaust gas temperature is 200° C., is about 900 kcal/h per combustion amount of 10,000 kcal/h.

Since the radiating heat loss from the apparatus can be almost ignored, the heating efficiency of the conventional far infrared rays radiating apparatus is $(10,000-2,500)/10,000=0.75$, i.e., 75%. In the apparatus of the invention, it is $(1,000-900)/10,000=0.91$, i.e., 91%. Therefore $75/91=0.82$. The apparatus of the invention has an energy saving effect of about 18% better than the conventional apparatus.

Therefore, even if the gaseous fuel such as the same town gas as in the conventional apparatus is used as a fuel, the fuel cost can be saved by at least about 18%. Further, if a kerosine, which will be explained hereinafter, is used as a fuel, in the small-sized far infrared rays radiating apparatus, the fuel cost is reduced to ½ or less.

The apparatus of the invention also has the energy saving effects in addition to the above effects.

An explanation will be made with respect to the energy saving effects in the case where the apparatuses in the first and second embodiments were used as steam boilers or heat medium boilers other than the hot water boiler.

Recently, there are many examples in which the heat medium is heated to about 200° C. and used.

The heat medium which uses a petroleum as a raw material and can be used at about 200° C. is widely used.

Even in the steam boiler a temperature of boiler water when the steam pressure is 16 kg/cm$^2$, is about 200° C. However, the temperature of the exhaust gas of the boiler which exchanges the heat with the liquid of 200° C. obviously becomes 200° C. or more. If the heat transfer area is set to a large area than is needed, it is uneconomical. It is economical and general when the exhaust gas temperature is set to about 300° to 350 ° C.

On the other hand, in the far infrared rays radiating apparatus, in the case of the apparatus for heating, an object to be heated is at an ordinary temperature. In the case of the apparatus for sauna, the average temperature of the sauna room is set to 70° to 80° C. The exhaust gas temperature of the far infrared rays radiating apparatus for sauna which uses a gas as a fuel is about 180° to 200° C. Even if a kerosine is used as a fuel, it can be set to about 200° C. Therefore, even in the case of heating the heat medium or high temperature hot water in the apparatuses of the first and second embodiments mentioned above, the temperature of the exhaust gas can be set to about 200° C.

Therefore, by considering such a situation that the apparatus of the invention was installed for the high pressure steam boiler or high temperature heat medium boiler, it is possible to obtain an effect such that the exhaust gas temperature which was 300° to 350° C. is reduced to about 200° C. according to the present invention. Thus the heating efficiency of the boiler is raised by 5% to 7%. Together with the improving effect of the heating efficiency of the far infrared rays radiating apparatus, a large energy saving effect can be realized.

The effect disclosed in the item (2), namely the effect of the invention by enabling a hydraulic pressure spray type oil burner to be attached to the small-sized far infrared rays radiating apparatus will now be explained.

As mentioned in the conventional technique, even when on/off control is performed, it is difficult to manufacture the oil burning far infrared rays radiating apparatus of 15,000 kcal/h or less and such an apparatus is not yet put into practical use.

On the other hand, many demands of the small-sized far infrared rays radiating apparatuses exist. For example, there is a printing dryer of a printed matter which mainly uses an electric power of 10 kw to 20 kw as a heat source. If the heat source of such an apparatus is converted into the combustion heat of the fuel, it becomes about 10,000 to 20,000 kcal/h. It is obviously necessary to perform high/low control or proportional control.

The far infrared rays radiating apparatus for gas burning sauna which has been first put into practical use by the invention disclosed in the Official Gazette of Japanese Patent Application No. 130653/1982 set forth by the present inventor is thereafter rapidly and widely used. Its share is more and more increasing and is almost equal to that of the apparatuses using the electric power as the heat source.

In the case of the gas burning infrared rays radiating sauna heater for use in large sauna room such as in business sauna, and public bath, high/low control to automatically increase or decrease the combustion amount to 50% and 100% at 6,000 to 27,000 kcal/h is executed. Therefore the hydraulic pressure spray type oil burner in which 30,000 kcal/h is the minimum combustion amount is too large, so it cannot be attached.

In the first embodiment of the apparatus of the invention, the minimum amount is set to 6,000 kcal/h and in the second embodiment the minimum amount is set to 4,900 kcal/h. All of the gas burning infrared rays sauna heaters for use in large sauna rooms can be changed for the oil burning type.

In the places where a large sauna room is installed, such as in business saunas, public baths, the hot water which is secondarily generated in the apparatuses of the first and second embodiments of the invention is frequently used. The amount of necessary hot water is sufficiently larger than the quantity of hot water which is generated from the apparatus of the invention. The hot water generated can be effectively used by 100%.

An explanation has been above with respect to the large sauna apparatus. Further, there is a possibility that the apparatus of the invention which burns a kerosine is also widely used in smaller sauna equipment.

In the case of a sauna in which two to five persons can enter together, the heat input is about 3,000 kcal/h to 5,000 kcal/h. The business fields in which the sauna rooms of such a scale are installed include hotels, tourist homes, pensions, beauty parlors, sports facilities of tennis, golf, aerobics, or the like. These sauna rooms are being promptly and widely used. The sauna facility which is used for about one or two persons is being used as a slightly high grade home-use sauna facility.

According to the apparatus of the invention, a liquid fuel such as kerosine can be used as a heat source of the apparatus of such a small combustion amount.

In the second embodiment, it has been assumed that 80%, i.e., 4,800 kcal/h of the combustion gas whose temperature was reduced to about 800° C. is fed from the branch combustion gas passage 19 to the radiating pipes 10-1. However, if the boiler damper 18 in FIG. 3 is slightly opened and the far infrared rays radiating damper 20 is slightly closed, a quantity of combustion gas which flows through the radiating pipes 10-1 can be freely decreased. Thus a radiating amount of the far infrared rays decreases and approximate amount of the heat reduced is additionally to the hot water in that degree.

As explained above, the oil burning far infrared rays radiating apparatus of a smaller heat amount can be easily manufactured as necessary.

The hot water which is secondarily generated at this time can be effectively used by 100% since the bath equipment is certainly installed in the sauna apparatus.

The inventor of the apparatus in this invention has invented a gas burning far infrared rays radiating sauna heater in the past. This sauna heater is being rapidly and widely used since the fuel cost is reduced to ½ as compared with the conventional sauna heater by an electric power. However, according to the present invention, the heating efficiency is further raised and the necessary energy amount is saved by about 18%. If the kerosine whose cost per calory is near ½ of that of the gas is used as a heat source, the necessary energy amount is further reduced to ⅓. If the kerosine burning far infrared rays radiating apparatus of the invention is used in place of the sauna apparatuses using an electric power as a heat source which have already been widely installed, the fuel cost is reduced to about ¼ and a large fuel cost saving effect is obtained and a possibility that the apparatus of the invention is rapidly and widely used is large.

The effects disclosed in the item (3), namely a method of using the hot water, steam, hot air, and high temperature heat medium which are secondarily generated by the apparatus of the invention will now be explained.

As mentioned above, the hot water generated by the sauna apparatus can be used in the bath room relative to the sauna apparatus. However, different from such uses, a consideration will now be made hereinbelow with respect to some methods whereby the far infrared rays generated and the heat sources which are secondarily generated are combined and an object to be heated is heated, and thereby producing the multieffects.

(a) As a method of heating a large space in gymnasium, indoor pool, or the like, two systems of a far infrared rays radiating heating system and a floor heating system have recently been highlighted.

In the case of heating a large space, a great quantity of energy is needed to heat the air in the whole space. Even if the air is heated, the high temperature air moves upward because the specific gravity is small. There is a drawback such that the temperature of the important space on the floor where many men are standing hardly increases. From this viewpoint, the energy radiating heating system for directly irradiating to a human body such an energy as to be hardly absorbed by the air and to be easily absorbed into the human body is the optimum system.

Further, even in the case of a gymnasium or pool, it is sufficient to heat only the portions near the peripheral walls. This is because many persons who are playing sports generally stay in the central region of a gymnasium, so there is no need to heat this region, and it is enough to heat only the peripheral spectators or audiences. The center of the pool is just the water, so there is no need to heat the human bodies in the water.

The far infrared rays radiating pipe in the apparatus of the invention is attached to the wall surface or suspended in the upper portion of the location where men gather and the far infrared rays are directly irradiated toward the human bodies. At the same time, the hot water which is secondarily generated is allowed to pass through the portion under the floor near the wall surface or the portion under the floor where men gather.

By constituting a floor heating apparatus in this manner, an ideal heating apparatus for a large space is realized.

(b) Although the object quite differs, the apparatus of the invention can be used as a heating apparatus for a hothouse in substantially the same manner as mentioned above.

If the apparatus of the invention is suspended to the upper portion of the hothouse, the far infrared rays are irradiated to plants from the upper position, and the hot water which is secondarily generated is used to heat the portions near the roots of the plants, thus an ideal heating apparatus for a hothouse is realized.

(c) There is a method whereby the high temperature heat medium which is secondarily generated is used as a heat source of an extending portion of the far infrared rays radiating apparatus.

There is considered a method whereby a temperature of heat medium is raised to about 200° C. and this heat medium is then pressurized by a pump and supplied from the apparatus in the first or second embodiment of the invention to the location which needs the irradiation of the far infrared rays, the heat medium is allowed to flow through the inside of a tubular radiator made of iron or copper, the far infrared rays are irradiated from the outer surface of the radiator, the human body or object is heated, the heat medium whose temperature was reduced is again returned to the apparatus of this invention and again heated and returned to the radiator, the far infrared rays are generated using the combustion gas as a heat source by the apparatus of the invention, the far infrared rays are also generated and irradiated from the high temperature heat medium which is secondarily generated, and all of the heat obtained by the apparatus of the invention are converted into the far infrared rays and used.

If the temperature of the heat medium is increased to about 200° C., the surface temperature of the radiator can be set to about 150° C. A wavelength of light which is most strongly irradiated from an object of about 150° C. is about 6.8 micron and this light is also a far infrared ray which can be easily absorbed into the water or organic substance. Such a heat medium is ideal as a heat source for heating or drying.

When the radiating pipe of the apparatus of the invention is extended too far, the temperature of combustion gas decreases too low. Therefore it can heat only the portion near the apparatus installed. However, in the case of the heat medium, the temperature of the pipe is held and the heat medium is pressurized and sent by a pump. The far infrared rays can be irradiated to the necessary portions.

If the present system is used in the heating apparatus for a large space mentioned above, the apparatus of the invention is installed at the location where men gather and the far infrared rays are directly irradiated, and further, if the heat medium is sent to the location such as a passage where men sometimes pass, location of a small space where a few men are always present, or the like and the far infrared rays are generated at the necessary locations; thus, the large space can be heated by a small amount of energy.

In addition to this, the applicable range for a dryer of foods, painting apparatus, printing apparatus for printing, or the like is wide.

In the apparatus mentioned above, if the steam is generated by the apparatus of the invention and this steam is used in place of the heat medium, an almost similar heating apparatus is realized.

(d) With respect to the case where the hot air is secondarily generated by the apparatus of the invention, as already described in the third embodiment, the foot portions are heated by the hot air by one apparatus of the invention so as to surround the human body and the upper portion of the human body can be heated by irradiating the far infrared rays thereto.

The apparatus of the third embodiment is an optimum and a heating apparatus of the location such as cold district and pool, where it is necessary to rapidly warm the cold human body. If this apparatus is used as a printing dryer for printing, painting, or the like, when the heating is performed by the far infrared rays and the evaporated solvent or steam is blown out by the hot air and the heating is also performed by the hot air while reducing the humidity of the evaporation surface, it is possible to more certainly and more rapidly dry as compared with the apparatus using only the hot air or far infrared rays.

The main effects of the invention have been described above. In addition to these effects, various kinds of effects or uses are available.

For example, in each of the embodiments of the invention, there are features such that it is hardly necessary to keep the temperature and the radiating heat loss is also small.

In the ordinary boiler or hot air generating apparatus, the heat radiation from the apparatus results in the loss of heat. Therefore it is obviously necessary to keep the temperature and even if the temperature is held, the radiated heat is slightly lost. (In most cases, it is about 1% of the combustion amount.)

On the other hand, according to the apparatus of the invention, most of the apparatus is installed in the heating room 1. Therefore the heat radiated from the apparatus is effectively used as a heat to heat the heating room 1.

For example, in the case where the air in the air heating chamber 23 in FIG. 4 showing the third embodiment of the apparatus of the invention is heated to a high temperature of about 200° C. or in the case where the heat medium is heated to about 200° C. in the first or second embodiment, the temperature of the outer cylinder 6 rises to a high temperature of 150° C. or more and a large amount of heat is irradiated. However, this irradiated heat is obtained just by the far infrared rays and provides an effective energy to heat a human body or object in the heating room 1.

In the case of heating the hot water in the first or second embodiment, there is also a case where the temperature of the outer cylinder 6 is lower than the temperature of the heating room 1. However, even in this case the heat in the heating room 1 is transferred to the water in the water chamber 7 and the hot water is produced and used, so that the heat is not lost.

The objects of developing the apparatuses of the invention are: to raise the heating efficiency of a far infrared rays radiating apparatus by the combustion heat; to develop a small-sized far infrared rays radiating apparatus using a fuel oil as a heat source; to enable any of electric power, gas, and oil to be used as a heat source as necessary; to enable a heat source to be freely selected in accordance with the use object; to secondarily generate the hot water, hot air, high temperature heat medium, or the like at a heating efficiency not lower than that in the conventional apparatus; to simultaneously generate the far infrared rays and other heat sources by the single apparatus; and to more efficiently heat a human body and object by organically combining both of those heat sources. These objects are accomplished by constitution, operation, and effects of the present invention as mentioned above.

The constitution of the invention is not limited to the foregoing embodiments but incorporates all of the modifications and variations which can be easily thought by a person with ordinary skill in the art from the foregoing description within the scope of the objects of the invention.

What I claim is:

1. In a heating system which produces far infrared rays:

combustion chamber means for burning fluid fuel with a fuel-air ratio not greater than 1.6, said combustion chamber means having an exhaust outlet, fluid chamber means associated with said combustion chamber means for carrying away so much heat from said combustion chamber means so that the temperature at said exhaust outlet is reduced at least as low as 800° C. above ambient and radiating means for radiating infrared rays in which most of the radiated energy has a wavelength in the far infrared range, said radiating means comprising an exhaust system which receives exhaust gases from said exhaust outlet and directs them along a circuitous path to provide an extended radiating area.

2. A heating system as defined in claim 1 in which most of said infrared energy has a wavelength between 1 and 30 microns.

3. In a heating system as defined in claim 2:

said circuitous path comprising at least three closely spaced parallel paths.

4. In a heating system as defined in claim 3, an exhaust blower downstream of said circuitous path.

5. In a heating system as defined in claim 4 in which the temperature at said exhaust outlet is not greater than about 500° C. above ambient.

6. In a heating system as defined in claim 1:

said radiated energy having a wavelength of about 4 microns.

7. In a heating system as defined in claim 1:

said exhaust system comprising at least three closely spaced parallel exhaust pipes that form a substantially continuous radiating surface area.

8. In a heating system:

combustion chamber means, having fuel and air inlets, for burning fuel, and also having first and second exhaust outlets, a first exhaust system for directing exhaust gases along a circuitous path to provide an extended radiating area and fed by and connected to said first exhaust outlet, a second exhaust system fed by and connected to said second exhaust outlet, said first exhaust system comprising means for radiating infrared rays and said second exhaust system comprising means for leading the products of combustion out of said combustion chamber means, and means for varying the relative percentages of exhaust gases flowing in the two exhaust systems, to thereby vary the amount of heat produced by said first exhaust system.

9. In a heating system as defined in claim 8, in which said means for varying relative percentages comprises:

a first damper in said first exhaust system, a second damper in said second exhaust system, and control means for at least partially closing of one of said dampers while at least partially opening the other of said dampers.

10. In a heating system as defined in claim 9:

said control means comprising thermostatic means, responsive to the temperature of a space heated by one of said exhaust systems, for regulating the temperature of such space.

11. In a heating system as defined in claim 8:

means for cooling said combustion chamber means so that said first and said second exhaust systems radiate predominately far infrared rays, first damper means in said first exhaust system, second damper means in said second exhaust system, and control means for operating said dampers so that when either of the dampers is being moved toward a closed position the other one is moved toward an open position and so that when either of the dampers is being moved toward an open position the other one is moved toward a closed position.

12. In a heating system as defined in claim 11 in which said control means is a thermostatic control means responsive to the temperature of the space heated by the heating system.

13. In a heating system as defined in claim 11:

said means for cooling said combustion chamber means comprising a water jacket for passing water over at least a portion of said chamber.

14. In an infrared radiating system, infrared radiating means comprising an exhaust system having an enlarged area and which directs exhaust gases in a circuitous path to thus heat said enlarged area of the exhaust system so that the exhaust system radiates infrared rays, combustion chamber means for burning fuel at not greater than a 1.6 fuel-air ratio and for discharging the products of combustion into said exhaust system, said combustion chamber means having an outer side, and means for circulating fluid over said outer side of said combustion chamber means to reduce the temperature of the products of combustion fed to said exhaust system to at least 800 degrees Centigrade above ambient and to lower the wavelength of the infrared radiation from said exhaust system so that most of the energy radiated therefrom has a wavelength no greater than 0.1 millimeters.

15. In an infrared radiating system as defined in claim 14:

said exhaust system having first and second exhaust pipes, a first damper in said first exhaust pipe, a second damper in said second exhaust pipe, and means interconnecting said dampers so that whenever either damper is at least partly opened the other is at least partially closed.

16. In an infrared radiating system as defined in claim 15, said last-named means comprising control means.

17. In an infrared radiating system as defined in claim 16 in which said control means is a thermostatic control means for regulating the temperature of the space in which said system is located.

18. In an infrared radiating system as defined in claim 14, said means for circulating fluid over said outer side including an air flow path downstream of said outer side and also including a blower for forcing air over said combustion chamber, said air flow path downstream of said outer side defining a slit-like blow-out port.

19. In an infrared radiating system as defined in claim 18 in which the predominating wavelengths of the radiated energy are between 1 and 30 microns.

20. In an infrared radiating system as defined in claim 14:

said means for circulating fluid including water jacket means for passing water over at least a part of said outer side.

* * * * *